US008211840B2

(12) United States Patent
Devlin et al.

(10) Patent No.: US 8,211,840 B2
(45) Date of Patent: Jul. 3, 2012

(54) ADDITIVES AND LUBRICANT FORMULATIONS FOR IMPROVED ANTIWEAR PROPERTIES

(75) Inventors: Mark T. Devlin, Richmond, VA (US); John T. Loper, Richmond, VA (US); Roger M. Sheets, Pagosa Springs, CO (US); Gregory H. Guinther, Richmond, VA (US); Jeffrey M. Guevremont, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 400 days.

(21) Appl. No.: 12/330,774

(22) Filed: Dec. 9, 2008

(65) Prior Publication Data

US 2010/0144563 A1 Jun. 10, 2010

(51) Int. Cl.
*C10M 137/00* (2006.01)

(52) U.S. Cl. ..... 508/385; 508/421

(58) Field of Classification Search ..... 508/506, 508/385, 421
See application file for complete search history.

(56) References Cited

U.S. PATENT DOCUMENTS

| | | | |
|---|---|---|---|
| 2,384,577 | A | 9/1945 | Thomas |
| 2,680,123 | A | 6/1954 | Mulvany |
| 2,710,872 | A | 6/1955 | Thompson |
| 2,786,866 | A | 3/1957 | Hook et al. |
| 2,897,152 | A | 7/1959 | Elliot et al. |
| 3,219,666 | A | 11/1965 | Norman et al. |
| 3,224,973 | A | 12/1965 | Knapp |
| 3,407,222 | A | 10/1968 | Lies |
| 3,565,804 | A | 2/1971 | Honnen et al. |
| 3,697,574 | A | 10/1972 | Piasek et al. |
| 3,736,357 | A | 5/1973 | Piasek et al. |
| 3,867,359 | A | 2/1975 | Beadle |
| 3,974,081 | A | 8/1976 | Rutkowski et al. |
| 4,029,587 | A | 6/1977 | Koch |
| 4,158,633 | A | 6/1979 | Papay |
| 4,234,435 | A | 11/1980 | Meinhardt et al. |
| 4,293,432 | A | 10/1981 | Papay et al. |
| 4,592,851 | A | 6/1986 | Stadtmiller et al. |
| 4,636,322 | A | 1/1987 | Nalesnik |
| 4,758,362 | A | 7/1988 | Butke |
| 4,876,375 | A | 10/1989 | Lam |
| 4,885,365 | A | 12/1989 | Lam |
| 4,904,401 | A | 2/1990 | Ripple et al. |
| 4,927,552 | A | 5/1990 | Lam |
| 4,957,643 | A | 9/1990 | Lam |
| 4,957,649 | A | 9/1990 | Ripple et al. |
| 5,204,012 | A | 4/1993 | Schaffhausen |
| 5,627,259 | A | 5/1997 | Thaler et al. |
| 5,633,326 | A | 5/1997 | Patil et al. |
| 5,643,859 | A | 7/1997 | Gutierrez et al. |
| 5,686,397 | A | 11/1997 | Baranski et al. |
| 5,693,598 | A | 12/1997 | Abraham et al. |
| 5,728,656 | A | 3/1998 | Yamaguchi et al. |
| 5,789,357 | A | 8/1998 | Baranski et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,902,776 | A | 5/1999 | Dohner et al. |
| 5,925,600 | A | 7/1999 | Atherton |
| 5,936,041 | A | 8/1999 | Diana et al. |
| 6,034,040 | A | 3/2000 | Ozbalik et al. |
| 6,114,288 | A | 9/2000 | Fujitsu et al. |
| 6,187,723 | B1 | 2/2001 | Holt et al. |
| 6,482,778 | B2 | 11/2002 | Tersigni et al. |
| 6,599,865 | B1 | 7/2003 | Esche, Jr. et al. |
| 6,809,069 | B2 | 10/2004 | Deshimaru et al. |
| 7,696,137 | B2 | 4/2010 | Yagishita |
| 2004/0176260 | A1 | 9/2004 | Shirahama et al. |
| 2004/0266630 | A1 | 12/2004 | George et al. |
| 2005/0143266 | A1 * | 6/2005 | Yagishita ..... 508/294 |

FOREIGN PATENT DOCUMENTS

| | | | |
|---|---|---|---|
| EP | 280579 | A2 | 2/1988 |
| EP | 330522 | B1 | 8/1989 |
| EP | 493928 | A1 | 7/1992 |
| EP | 768366 | A1 | 4/1997 |
| GB | 1469479 | | 4/1977 |
| JP | 11310786 | | 11/1999 |

* cited by examiner

*Primary Examiner* — Walter D Griffin
*Assistant Examiner* — Taiwo Oladapo
(74) *Attorney, Agent, or Firm* — Luedeka Neely Group, P.C.

(57) ABSTRACT

Lubricated surfaces and lubricant compositions for lubricating a surface. The lubricated surface is provided by a lubricant composition including a base oil of lubricating viscosity, at least one metal salt of phosphorothioic acid, and an ashless, sulfur-free organophosphorus compound providing a metal to phosphorus weight ratio ranging from about 0.25:1 to about 1.0:1 by weight. The lubricant composition is substantially devoid of molybdenum.

19 Claims, No Drawings

ADDITIVES AND LUBRICANT FORMULATIONS FOR IMPROVED ANTIWEAR PROPERTIES

TECHNICAL FIELD

The embodiments described herein relate to particular antiwear agent combinations that include a metal salt of phosphorothioic acid and an ashless, sulfur-free phosphorus compound and use of such antiwear agent combination in lubricant oil formulations.

BACKGROUND AND SUMMARY

Lubricating oils used in passenger cars and heavy duty diesel engines have changed over the years. Today's engines are designed to run hotter and harder than in the past. Various additives have been added to lubricant formulations in order to reduce wear between moving parts. One particularly common antiwear additive is a zinc dialkyl dithiophosphate ("ZnDDP"). While such zinc compounds are particularly useful as antiwear agents, such zinc compounds may have one or more of the following disadvantages: increased levels of sulfur and/or phosphorus in the finished lubricant.

Future generations of passenger car motor oils and heavy duty diesel engine oils require lower levels of phosphorus and sulfur in the finished oil in order to protect pollution control devices as it is well known that sulfur and phosphorus containing additives may poison or otherwise reduce the effectiveness of pollution control devices. For example, current GF-4 motor oil specifications require a finished oil to contain less than 0.08 wt % and 0.7 wt % phosphorus and sulfur, respectively, and PC-10 motor oil specifications, the next generation heavy duty diesel engine oil, requires oils to contain less than 0.12 wt % and 0.4 wt % phosphorus and sulfur, respectively, and 1.0 wt % sulfated ash. Certain antiwear additives known in the industry contain phosphorus and sulfur at levels which reduce the effectiveness of pollution control devices.

Therefore, a need exists for lubricant additives and compositions that provide enhanced antiwear properties and which are more compatible with pollution control devices used for automotive and diesel engines. A need also exists for such lubricant additives and compositions which are more compatible with such pollution control devices without adversely affecting oil solubility, corrosion, and/or darkening the color of the finished lubricant. Such additives may contain phosphorus and/or sulfur and may be substantially devoid of molybdenum compounds.

In one embodiment herein is presented a lubricated surface including a base oil of lubricating viscosity, at least one metal salt of phosphorothioic acid, and an ashless, sulfur-free organophosphorus compound providing a metal to phosphorus weight ratio ranging from about 0.25:1 to about 1.0:1 by weight. The lubricant composition is substantially devoid of molybdenum.

In another embodiment, there is provided a vehicle having moving parts and containing a lubricant for lubricating the moving parts. The lubricant includes a base oil of lubricating viscosity, at least one metal salt of phosphorothioic acid, and an ashless, sulfur-free organophosphorus compound providing a metal to phosphorus weight ratio ranging from about 0.25:1 to about 1.0:1 by weight. The lubricant is substantially devoid of molybdenum.

In yet another embodiment there is provided a fully formulated lubricant composition including a base oil component of lubricating viscosity and an antiwear agent having at least one metal salt of phosphorothioic acid and an ashless, sulfur-free organophosphorus compound. The antiwear agent provides the lubricant composition with a metal to phosphorus weight ratio ranging from about 0.25:1 to about 1.0:1 by weight and a sulfur to phosphorus ratio ranging from about 0.5:1 to less than about 2.0:1 by weight. The lubricant composition is substantially devoid of molybdenum.

As set forth briefly above, embodiments of the disclosure provide a combination of an antiwear composition that includes a hydrocarbon soluble phosphoric acid metal salt and an ashless, sulfur-free organophosphorus compound that may significantly improve the antiwear properties of a lubricant composition and may enable a decrease in the amount of phosphorus and sulfur additives required for equivalent antiwear improving characteristics. The additive may be mixed with an oleaginous fluid that is applied to a surface between moving parts. The moving parts may be moving parts of an engine or transmission. Engine parts include parts of passenger car engines and heavy duty diesel engines. In other applications, the additive may be provided in a fully formulated lubricant composition. The additive is particularly directed to meeting the currently proposed GF-4 standards for passenger car motor oils and PC-10 standards for heavy duty diesel engine oils, as well as future passenger car and diesel engine oil specifications and standards.

An advantage of the embodiments described herein is that combinations of metal containing and ashless, sulfur-free phosphorus compounds surprisingly exhibit better wear performance than either component while also providing lower coefficients of friction. Other features and advantages of the compositions and methods described herein may be evident by reference to the following detailed description which is intended to exemplify aspects of the embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment is presented a novel composition useful as a component in lubricating oil compositions. The composition comprises an antiwear agent that includes a metal salt of phosphorothioic acid and an ashless, sulfur-free, organophosphorus compound that provides a ratio of metal to phosphorus ranging from about 0.25:1 to about 1:1.

As used herein, the term "hydrocarbyl" refers to a group having a carbon atom attached to the remainder of the molecule and having predominantly hydrocarbon character. Examples of hydrocarbyl groups include:

a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);
b) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);
c) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

A first primary component of the antiwear agent for lubricant compositions is the metal salt of phosphorothioic acid. Of the metal salts of phosphorithioic acid, a particularly suitable metal salt is zinc dihydrocarbyl dithiophosphate ("ZnDDP"). ZnDDPs have good antiwear and antioxidant properties. Many patents address the manufacture and use of ZnDDPs including U.S. Pat. Nos. 4,904,401; 4,957,649; and 6,114,288. Non-limiting general ZnDDP types are primary, secondary and mixtures of primary and secondary alkyl and aryl ZnDDPs. Examples of such compounds include, but are not limited to: zinc O,O-di($C_{1-14}$-alkyl)dithiophosphate; zinc (mixed O,O-bis(sec-butyl and isooctyl)) dithiophosphate; zinc-O,O-bis(branched and linear $C_{3-8}$-alkyl)dithiophosphate; zinc O,O-bis(2-ethylhexyl)dithiophosphate; zinc O,O-bis(mixed isobutyl and pentyl)dithiophosphate; zinc mixed O,O-bis(1,3-dimethylbutyl and isopropyl)dithiophosphate; zinc O,O-diisooctyl dithiophosphate; zinc O,O-dibutyl dithiophosphate; zinc mixed O,O-bis(2-ethylhexyl and isobutyl and isopropyl)dithiophosphate; zinc O,O-bis(dodecylphenyl)dithiophosphate; zinc O,O-diisodecyl dithiophosphate; zinc O-(6-methylheptyl)-O-(1-methylpropyl)dithiophosphate; zinc O-(2-ethylhexyl)-O-(isobutyl) dithiophosphate; zinc O,O-diisopropyl dithiophosphate; zinc (mixed hexyl and isopropyl)dithiophosphate; zinc (mixed O-(2-ethylhexyl) and O-isopropyl)dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl) dithiophosphate.

The second component of the antiwear agent is an ashless, sulfur-free organophosphorus compound certain phosphorus esters such as alkyl hydrocarbyl phosphonate. The alkyl hydrocarbyl phosphonate may include, but is not limited to, O,O-di-(primary alkyl)acyclic hydrocarbyl phosphonates in which the primary alkyl groups are the same or different each independently containing 1 to 4 carbon atoms and in which the acyclic hydrocarbyl group bonded to the phosphorus atom contains 12 to 24 carbon atoms and is a linear hydrocarbyl group free of acetylenic unsaturation. Exemplary compounds may include O,O-dimethyl hydrocarbyl phosphonates, O,O-diethyl hydrocarbyl phosphonates, O,O-dipropyl hydrocarbyl phosphonates, O,O-dibutyl hydrocarbyl phosphonates, O,O-diiso-butyl hydrocarbyl phosphonates, and analogous compounds in which the two alkyl groups differ, such as, for example, O-ethyl-O-methyl hydrocarbyl phosphonates, O-butyl-O-propyl hydrocarbyl phosphonates, and O-butyl-O-isobutyl hydrocarbyl phosphonates, wherein in each case the hydrocarbyl group is linear and is saturated or contains one or more olefinic double bonds, each double bond preferably being an internal double bond. Particularly suitable are those phosphonate compounds in which both O,O-alkyl groups are identical to each other. Also suitable are compounds in which the hydrocarbyl group bonded to the phosphorus atom contains 16 to 20 carbon atoms. A particularly suitable phosphonate compound for use in combination with the metal salt of phosphorothioic acid is dimethyloctadecyl phosphonate. Phosphonate esters are described in U.S. Pat. No. 4,158,633.

The amount of phosphorus in the lubricant composition provided by the antiwear additive suitably ranges from about 100 to about 800 ppm by weight phosphorus in a fully formulated lubricant composition. Other amounts of phosphorus in the lubricant composition may range from about 200 to about 700 ppm by weight in the fully formulated lubricant composition.

It has also been discovered, quite surprisingly, that better wear performance may be obtained when the lubricant composition has a sulfur to phosphorus ratio within a particular range. For example, weight ratio of sulfur to phosphorus may range from about 0.5:1 to less than about 2.0:1. Hence, the sulfur and phosphorus contents of the lubricant composition may be less than about 1.0 wt % sulfur and less than about 0.1 wt % phosphorus based on a total weight of the lubricant composition.

The antiwear agents of the embodiments described herein are advantageously incorporated into lubricating compositions. Accordingly, the antiwear agent may be added directly to the lubricating oil composition. In one embodiment, however, the antiwear agent is diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form an antiwear additive concentrate. The antiwear concentrates usually contain from about 0% to about 99% by weight diluent oil.

In the preparation of lubricating oil formulations it is common practice to introduce the antiwear concentrates in the form of about 1 to about 99 wt. % active ingredient concentrates in hydrocarbon oil, e.g. mineral lubricating oil, or other suitable solvent. Usually these concentrates may be added to a lubricating oil with a dispersant/inhibitor (DI) additive package and viscosity index (VI) improvers containing about 0.0 1 to about 50 parts by weight of lubricating oil per part by weight of the DI package to form finished lubricants, e.g., crankcase motor oils. Suitable DI packages are described, for example, in U.S. Pat. Nos. 5,204,012 and 6,034,040, the disclosures of which are herein incorporated by reference. Among the types of additives which may be included in the DI additive package are detergents, dispersants, friction modifiers, seal swell agents, antioxidants, foam inhibitors, lubricity agents, rust inhibitors, corrosion inhibitors, demulsifiers, pour point depressants, viscosity index improvers, and the like. Several of these components are well known to those skilled in the art and may be used in conventional amounts with the additives and compositions described herein.

The additives are typically blended into the base oil in an amount that enables that additive to provide its desired function. Representative effective amounts of the antiwear agent and additives, when used in crankcase lubricants, are listed in Table 1 below. All the values listed are stated as weight percent active ingredient.

TABLE 1

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ashless, sulfur-free phosphorus compound | 0.1-2.0 | 0.1-1.0 |
| Antifoaming agent | 0-5.0 | 0.001-0.15 |
| Pour point depressant | 0.01-5.0 | 0.01-1.5 |
| Viscosity modifier | 0.01-20.00 | 0.25-10.0 |

TABLE 1-continued

| Component | Wt. % (Broad) | Wt. % (Typical) |
|---|---|---|
| Molybdenum free friction modifier` | 0-2.0 | 0.1-1.0 |
| Base oil | Balance | Balance |
| Total | 100 | 100 |

In another embodiment, the antiwear concentrates may be top treated into a fully formulated motor oil or finished lubricant. The purpose of combining the antiwear concentrates and DI package, of course, is to make the handling of the various materials less difficult and awkward as well as to facilitate solution or dispersion in the final blend.

Lubricant compositions made with the antiwear agent described above are used in a wide variety of applications. For compression ignition engines and spark ignition engines, it is preferred that the lubricant compositions meet or exceed published GF-4 or API-CI-4 standards. Lubricant compositions according to the foregoing GF-4 or API-CI-4 standards include a base oil, the DI additive package, and/or a VI improver to provide a fully formulated lubricant. The base oil for lubricants according to the disclosure is an oil of lubricating viscosity selected from the group consisting essentially of mineral oils, synthetic lubricating oils, vegetable oils and mixtures thereof. Such base oils include those conventionally employed as crankcase lubricating oils for spark-ignited and compression-ignited internal combustion engines, such as automobile and truck engines, marine and railroad diesel engines, and the like. Such base oils are typically classified as Group I, Group II, Group III, Group IV and Group V, as described in Table 2 below.

TABLE 2

| Group I-V Base Oils | | | | |
|---|---|---|---|---|
| Base Oil | % Sulfur | | % Saturates | Viscosity Index |
| Group I | >0.03 | and/or | <90 | 80-120 |
| Group II | ≦0.03 | and/or | ≧90 | 80-120 |
| Group III | ≦0.03 | and/or | ≧90 | ≧120 |
| Group IV | * | | | |
| Group V | ** | | | |

* Group IV base oils are defined as all polyalphaolefins

** Group V base oils are defined as all other base oils not included in Groups I, II, III and IV and may include gas to liquid base oils.

Dispersant Components

Dispersants contained in the DI package may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors, or antioxidants, reduce the tendency of base stocks to deteriorate in service, which deterioration can be evidenced by the products of oxidation such as sludge and varnish-like deposits that deposit on metal surfaces and by viscosity growth of the finished lubricant. Such oxidation inhibitors include, but are not limited to, hindered phenols, sulfurized hindered phenols, alkaline earth metal salts of alkylphenolthioesters having about $C_5$ to about $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including, but not limited to, 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in U.S Publication No. 2004/0266630.

Diarylamine antioxidants include, but are not limited, to diarylamines having the formula:

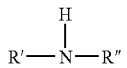

wherein R' and R" each independently represents a substituted or unsubstituted aryl group having from about 6 to about 30 carbon atoms. Illustrative of substituents for the aryl group include, but are not limited to, aliphatic hydrocarbon groups such as alkyl group having from about 1 to about 30 carbon atoms, hydroxy groups, halogen radicals, carboxylic acid or ester groups, or nitro groups.

The aryl group may be a substituted or unsubstituted phenyl or naphthyl. In one embodiment, one or both of the aryl groups are substituted with at least one alkyl group having from about 4 to about 30 carbon atoms. In another embodiment, one or both of the aryl groups are substituted with at least one alkyl group having from about 4 to about 18 carbon atoms. In yet another embodiment, one or both of the aryl groups are substituted with at least one alkyl group having from about 4 to about 9 carbon atoms. In still yet another embodiment, one or both of the aryl groups are substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus, the diarylamine may contain at least two nitrogen atoms wherein at least one nitrogen atom has two aryl groups attached thereto, e.g., as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

Another class of aminic antioxidants includes phenothiazine or alkylated phenothiazine having the chemical formula:

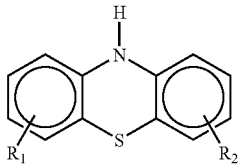

wherein $R_1$ is a linear or branched about $C_1$ to about $C_{24}$ alkyl, aryl, heteroalkyl or alkylaryl group and $R_2$ is hydrogen or a linear or branched about $C_1$- about $C_{24}$ alkyl, heteroalkyl, or alkylaryl group. Alkylated phenothiazine may be selected from the group consisting essentially of monotetradecylphenothiazine, ditetradecylphenothiazine, monodecylphenothiazine, didecylphenothiazine, monononylphenothiazine, dinonylphenothiazine, monoctyl-phenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. In one embodiment, high molecular weight olefins, i.e. those olefins having an average molecular weight of about 168 to about 351 g/mole, may be used. Non-limiting examples of olefins that may be used include alpha-olefins, isomerized alpha-olefins, branched olefins, cyclic olefins, and combinations of these.

Alpha-olefins include, but are not limited to, any about $C_4$ to about $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing about 20 weight % sulfur, when added to the finished lubricant at an approximately 1.0 weight % treat level, will deliver 2,000 ppm of sulfur to the finished lubricant. A sulfurized fatty oil or olefin containing about 10 weight % sulfur, when added to the finished lubricant at an approximately 1.0 weight % treat level, will deliver 1,000 ppm sulfur to the finished lubricant. In one embodiment, the sulfurized olefin or sulfurized fatty oil is added to deliver between about 200 ppm and less than about 1,000 ppm sulfur to the finished lubricant. The foregoing aminic, phenothiazine, and sulfur containing antioxidants are described, for example, in U.S. Pat. No. 6,599,865.

The ashless dialkyldithiocarbamates which may be used as antioxidant additives include, but are not limited to, compounds that are soluble or dispersable in the additive package. In one embodiment, the ashless dialkyldithiocarbamate may be of low volatility, and may have a molecular weight greater than about 250 Daltons. In yet another embodiment, the ashless dialkyldithiocarbamate may a molecular weight greater than about 400 Daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithio-carbamates, dithiocarbamates prepared from unsaturated compounds, dithiocarbamates prepared from norbornylene, and dithiocarbamates prepared from epoxides. In an embodiment, the alkyl groups of the dialkyldithiocarbamate may have from about 1 to about 16 carbons. Non-limiting examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Further examples of ashless dithiocarbamates may include, but are not limited to: methylenebis-(dibutyldithiocarbamate), ethylenebis(dibutyl-dithiocarbamate), isobutyl disulfide-2,2'-bis(dibutyldithiocarbamate), dibutyl-N,N-dibutyl-(dithiocar-bamyl)succinate, 2-hydroxypropyl dibutyldithiocarbamate, Butyl(dibutyldithio-carbamyl)acetate, and S-carbomethoxy-ethyl-N,N-dibutyl dithiocarbamate.

The antiwear agents described herein may be used with any or all of the foregoing antioxidants in any and all combinations and ratios. It is understood that various combinations of phenolic, aminic, sulfur containing additives may be optimized for the finished lubricant formulation based on bench or engine tests or modifications of the dispersant, VI improver, base oil, or any other additive.

Friction Modifier Components

Glycerides may be used alone or in combination with other molybdenum friction modifiers. Suitable glycerides include, but are not limited to, glycerides of the formula:

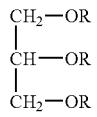

wherein each R is independently selected from the group consisting of H and C(O)R' where R' may be a saturated or an unsaturated alkyl group having from about 3 to about 23 carbon atoms. Non-limiting examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used. In an embodiment, from about 30% to about 70% of the available sites contain free hydroxyl groups (i.e., 30% to 70% of the total R groups of the glycerides represented by the above formula are hydrogen). In another embodiment, the glyceride is glycerol monooleate, which is generally a mixture of mono, di, and tri-glycerides derived from oleic acid, and glycerol.

Other Components

Rust inhibitors selected from the group consisting essentially of nonionic polyoxyalkylene polyols and esters thereof, polyoxyalkylene phenols, and anionic alkyl sulfonic acids may be used.

A small amount of a demulsifying component may be used. A preferred demulsifying component is described in EP Pat. No. 330,522, the disclosure of which is herein incorporated by reference. Such demulsifying component may be obtained by reacting an alkylene oxide with an adduct obtained by reacting a bis-epoxide with a polyhydric alcohol. The demulsifier should be used at a level not exceeding 0.1 mass % active ingredient. In an embodiment, a treat rate of about 0.001 to about 0.05 mass % active ingredient may be used.

Pour point depressants, otherwise known as lube oil flow improvers, lower the minimum temperature at which the fluid will flow or can be poured. Such additives are well known. Non-limiting examples of pour point depressant additives which improve the low temperature fluidity of the fluid are about $C_8$ to about $C_{18}$ dialkyl fumarate/vinyl acetate copolymers, polyalkylmethacrylates and the like.

Foam control can be provided by many compounds including, but not limited to, an antifoamant of the polysiloxane type, for example, silicone oil or polydimethyl siloxane.

Seal swell agents, as described, but not limited to, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Non-limiting examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may also be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The antiwear agent may be added directly to the lubricating oil composition. In one embodiment, however, the antiwear agent is diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. These concentrates usually contain from about 1% to about 100% by weight and in one embodiment about 10% to about 90% by weight of the antiwear agent.

Base Oils

Base oils suitable for use in formulating the compositions, additives and concentrates described herein may be selected from any of the synthetic, natural and mineral oils, or mixtures thereof. Non-limiting examples of synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include, but are not limited to, animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. In an embodiment, the base oil typically has a viscosity of about 2.5 to about 15 cSt. In another embodiment, the base oil has a viscosity of about 2.5 to about 11 cSt at 100° C. Such base oils include those conventionally employed as crankcase lubricating oils for spark-ignited and compression-ignited internal combustion engines, such as automobile and truck engines, marine and railroad diesel engines, and the like. These base oils are typically classified as Group I, Group II, Group III, Group IV and Group V. The above mentioned base oils are described above in Table 1.

The following examples are given for the purpose of exemplifying aspects of the embodiments and are not intended to limit the embodiments in any way.

EXAMPLE 1

In the following example, lubricant compositions were formulated with or without ZnDDP and with or without additional anti-wear component and/or friction modifier. The antiwear properties and friction coefficient of Samples 1-14 were determined in a High Frequency Reciprocating Wear Test Rig (HFRR). In the HFRR test, a steel ball immersed in the oil was oscillated across a steel disk at a speed of 20 Hz over a 1 mm path. A 7 Newton (.about. 1.0 GPa) load was applied between the ball and the disk and tests were performed while holding the oil at 120° C. for one hour. After testing, a two-dimensional profile of the wear scar on the disk was determined. The cross-sectional area of the wear scar was reported and listed in the following tables wherein the lower the value of the cross-sectional area, the better the anti-wear performance of the oil. Table 3 provides comparative data while table 4 illustrates the advantages of the disclosed embodiments.

TABLE 3

| Comparative Examples | | | | | | | | | | | | |
|---|---|---|---|---|---|---|---|---|---|---|---|---|
| Sample No. | ZnDDP (wt. %) | Sulfur-free ashless phosphorus (wt. %) | Dithio-Phosphate (wt. %) | Moly Dithio-carbamate (wt. %) | Zn (ppm) | P (ppm) | S (ppm) | Mo (ppm) | Zn/P Ratio By weight | S/P Ratio By weight | HFRR Wear ($\mu m^2$) | HFRR Coeff. Friction |
| 1 | 0 | 0 | 0 | 0 | 0 | 0 | — | 0 | — | — | 1140 | 0.153 |
| 2 | 0.63 | 0 | 0 | 0 | 578 | 519 | 10.38 | 0 | 1.11 | 2.00 | 308 | 0.122 |
| 3 | 0.80 | 0 | 0 | 0 | 698 | 637 | 12.74 | 0 | 1.10 | 2.00 | 224 | 0.135 |
| 4 | 0 | 0.42 | 0 | 0 | 0 | 345 | — | 0 | 0 | 0 | 758 | 0.094 |
| 5 | 0.80 | 0 | 0 | 0.40 | 698 | 637 | 1514 | 196 | 1.11 | 2.38 | 506 | 0.104 |
| 6 | 0.20 | 0 | 0.60 | 0 | 175 | 645 | 1290 | 0 | 0.27 | 2.00 | 247 | 0.112 |
| 7 | 0.40 | 0 | 0.40 | 0 | 333 | 650 | 1299 | 0 | 0.51 | 2.00 | 148 | 0.115 |
| 8 | 0.60 | 0 | 0.20 | 0 | 544 | 654 | 1309 | 0 | 0.85 | 2.00 | 193 | 0.105 |

TABLE 4

| Sample No. | ZnDDP (wt. %) | Sulfur-free ashless phosphorus (wt. %) | Dithio-Phosphate (wt. %) | Moly Dithio-carbamate (wt. %) | Zn (ppm) | P (ppm) | S (ppm) | Mo (ppm) | Zn/P Ratio By weight | S/P Ratio By weight | HFRR Wear ($\mu m^2$) | HFRR Coeff. Friction |
|---|---|---|---|---|---|---|---|---|---|---|---|---|
| 9 | 0.20 | 0.60 | 0 | 0 | 175 | 636 | 330 | 0 | 0.28 | 0.52 | 181 | 0.097 |
| 10 | 0.25 | 0.25 | 0 | 0 | 237 | 411 | 398 | 0 | 0.58 | 0.97 | 126 | 0.089 |
| 11 | 0.38 | 0.17 | 0 | 0 | 363 | 462 | 605 | 0 | 0.79 | 1.31 | 161 | 0.083 |
| 12 | 0.40 | 0.40 | 0 | 0 | 333 | 635 | 659 | 0 | 0.52 | 1.04 | 113 | 0.094 |
| 13 | 0.50 | 0.08 | 0 | 0 | 457 | 482 | 796 | 0 | 0.95 | 1.65 | 133 | 0.084 |
| 14 | 0.60 | 0.20 | 0 | 0 | 544 | 673 | 989 | 0 | 0.81 | 1.47 | 115 | 0.096 |

As shown by the foregoing results in samples 9-14, a combination of a ZnDDP compound and an ashless, sulfur-free phosphorus compound has a synergistic effect on the HFRR wear and HFRR coefficient of friction as compared to use of the ZnDDP or ashless, sulfur-free phosphorus compound alone as illustrated by Sample Nos. 2-4. In Samples 9-14, the wear ranges from 113 to 181 $\mu m^2$ and the coefficient of friction is below 0.100 for Zn/P ratios ranging from 0.28:1 to 0.95:1 and S/P ratios ranging from 0.52 to 1.65. By comparison, all of the Samples 2-6 and 8 have an HFRR wear of greater than 181 $\mu m^2$ and a coefficient of friction greater than 0.100. Sample 7 containing equal amounts of ZnDDP and dithiophosphate exhibits an HFRR wear of 148 $\mu m^2$, however, like the other samples, has a coefficient of friction above 0.100.

Sample 1 in Table 3 provides the characteristics of a base oil that is devoid of antiwear additives. Samples 2 and 3 provide data for a lubricant composition that contains only the ZnDDP additive. Accordingly to Samples 2-3, the HFRR wear is high ranging from 224 to 308 $\mu m^2$, and the friction coefficient for these samples is high ranging from 0.122 to 0.135. As shown by these samples increasing the ZnDDP decreases the wear but increases the coefficient of friction. Sample 4 provides the data for a lubricant composition that contains only the ashless, sulfur free phosphorus additive. In this sample, the wear is significantly higher than with the ZnDDP alone, however, the coefficient of friction is lower than for samples 2-3.

In an attempt to reduce the coefficient of friction, Sample 5 includes 0.40 wt. % of a molybdenum dithiocarbamate compound. As compared to Sample 3 with the same amount of ZnDDP, adding the molybdenum compound reduces the coefficient of friction, but increases the wear by over 100% versus Sample 3.

Samples 6-8 show the effect of increasing the Zn/P ratio by adding an ashless antiwear agent that contains both sulfur and phosphorus to the lubricant composition. Samples 6-8 show some improvement in wear and coefficient of friction, but the coefficient of friction remains above about 0.100. Only samples 9-14 containing both ZnDDP and an ashless, sulfur-free antiwear agent provide acceptable wear and coefficients of friction below 0.100.

Accordingly, it is expected that lubricant formulation containing from about 100 to about 600 ppm or more zinc metal, from about 400 to about 700 ppm phosphorus and from about 100 to about 1000 ppm sulfur may provide a synergistic increase in the wear performance and friction properties of a lubricant composition provided the Zn/P and S/P ratios are within certain ranges in the fully formulated lubricant composition.

At numerous places throughout this specification, reference has been made to a number of U.S. Patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricated surface comprising a lubricant composition including a base oil of lubricating viscosity, (a) at least one metal salt of phosphorothioic acid, and (b) an ashless, sulfur-free di-alkyl phosphonate compound, wherein components (a) and (b) together have a metal to phosphorus weight ratio ranging from about 0.25:1 to about 1.0:1 by weight, a weight ratio of (a) to (b) in the lubricant composition ranges from about 0.33:1 to about 6:1, and wherein the lubricant composition is substantially devoid of molybdenum, and the lubricant composition has a phosphorus content ranging from about 200 to about 800 ppm by weight based on a total weight of the lubricant composition.

2. The lubricated surface of claim 1, wherein the lubricated surface comprises an engine drive train.

3. The lubricated surface of claim 1, wherein the lubricated surface comprises an internal surface or component of an engine selected from the group consisting of an internal combustion engine and a compression ignition engine.

4. The lubricated surface of claim 1, wherein components (a) and (b) together have a sulfur to phosphorus ratio ranging from about 0.5:1 to less than about 2.0:1 by weight.

5. The lubricated surface of claim 1, wherein a total amount of phosphorus provided by components (a) and (b) in the lubricant composition is less than about 0.1 weight percent based on a total weight of the lubricant composition.

6. The lubricated surface of claim 1, wherein the ashless, sulfur-free di-alkyl phosphonate compound comprises O,O-di-(primary alkyl)acyclic hydrocarbyl phosphonate wherein the alkyl group contains from 1 to 4 carbon atoms and the acyclic hydrocarbyl group contains from 12 to 24 carbon atoms.

7. The lubricated surface of claim 1, wherein metal salt of phosphorothioic acid comprises zinc dihydrocarbyl dithiophosphate.

8. A motor vehicle comprising the lubricated surface of claim 1.

9. A vehicle having moving parts and containing a lubricant for lubricating the moving parts, the lubricant comprising a base oil of lubricating viscosity, (a) at least one metal salt of phosphorothioic acid, and (b) an ashless, sulfur-free di-alkyl phosphonate compound, wherein components (a) and (b) together have a metal to phosphorus weight ratio ranging from about 0.25:1 to about 1.0:1 by weight, a weight ratio of (a) to (b) in the lubricant ranges from about 0.33:1 to about 6:1, and wherein the lubricant is substantially devoid of molybdenum, and the lubricant composition has a phosphorus content ranging from about 200 to about 800 ppm by weight based on a total weight of the lubricant composition.

10. The vehicle of claim 9, wherein components (a) and (b) together have a sulfur to phosphorus ratio ranging from about 0.5:1 to less than about 2.0:1 by weight.

11. The vehicle of claim 9, wherein the metal of the phosphorothioic acid comprises zinc.

12. The vehicle of claim 9, wherein the lubricant composition comprises from about 200 to about 500 ppm by weight phosphorus.

13. A fully formulated lubricant composition comprising a base oil component of lubricating viscosity, and an antiwear agent comprising (a) at least one metal salt of phosphorothioic acid and (b) an ashless, sulfur-free di-alkyl phosphonate compound, wherein the antiwear agent has a metal to phosphorus weight ratio ranging from about 0.25:1 to about 1.0:1 by weight, a weight ratio of (a) to (b) in the lubricant composition ranges from about 0.33:1 to about 6:1, and wherein the lubricant composition is substantially devoid of molybdenum, and the lubricant composition has a phosphorus content ranging from about 200 to about 800 ppm by weight based on a total weight of the lubricant composition.

14. The lubricant composition of claim 13, wherein the antiwear agent has a sulfur to phosphorus ratio ranging from about 0.5:1 to less than about 2.0:1 by weight.

15. The lubricant composition of claim 13, wherein the di-alkyl phosphonate comprises O,O-di-(primary alkyl)acyclic hydrocarbyl phosphonate wherein the alkyl group contains from 1 to 4 carbon atoms and the acyclic hydrocarbyl group contains from 12 to 24 carbon atoms.

16. The lubricant composition of claim 13, wherein the metal of the phosphorothioic acid comprises zinc.

17. The lubricant composition of claim 13, wherein metal salt of phosphorothioic acid comprises zinc dihydrocarbyl dithiophosphate.

18. The lubricant composition of claim 13, wherein the antiwear agent provides from about 200 to about 700 ppm weight total phosphorus to the fully formulated lubricant composition.

19. The lubricant composition of claim 13 wherein the lubricant composition comprises a low ash, low sulfur, and low phosphorus lubricant composition suitable for compression ignition engines such that the lubricant composition contains less than about 1.0 wt % sulfur.

* * * * *